US011441370B2

(12) United States Patent
McInally

(10) Patent No.: US 11,441,370 B2
(45) Date of Patent: Sep. 13, 2022

(54) APPARATUS FOR USE IN A TRACTOR IN A WELLBORE AND METHODS

(71) Applicant: Qinterra Technologies AS, Stavanger (NO)

(72) Inventor: Gerald McInally, Bryne (NO)

(73) Assignee: Qinterra Technologies AS, Stavanger (NO)

( * ) Notice: Subject to any disclaimer, the term of this patent is extended or adjusted under 35 U.S.C. 154(b) by 226 days.

(21) Appl. No.: 15/562,670

(22) PCT Filed: Mar. 31, 2016

(86) PCT No.: PCT/NO2016/050059

§ 371 (c)(1),
(2) Date: Sep. 28, 2017

(87) PCT Pub. No.: WO2016/159780

PCT Pub. Date: Oct. 6, 2016

(65) Prior Publication Data

US 2018/0119503 A1 May 3, 2018

(30) Foreign Application Priority Data

Apr. 1, 2015 (NO) ..... 20150395

(51) Int. Cl.
*E21B 23/00* (2006.01)
*E21B 23/14* (2006.01)

(52) U.S. Cl.
CPC ..... *E21B 23/00* (2013.01); *E21B 23/14* (2013.01); *E21B 23/001* (2020.05)

(58) Field of Classification Search
CPC .... E21B 23/00; E21B 23/14; E21B 2023/008; E21B 23/001
See application file for complete search history.

(56) References Cited

U.S. PATENT DOCUMENTS 5,375,668 A 12/1994 Hallundbaek
2010/0012315 A1* 1/2010 McInally ..... E21B 23/14 166/241.5

(Continued)

FOREIGN PATENT DOCUMENTS

EP 2505766 A1 10/2012
WO 0046481 A2 8/2000

(Continued)

OTHER PUBLICATIONS

Qinterra Wireline Tractor Catalogue, rev. Oct. 2, 2014 ONLINE: https://issuu.com/qinterratechnologies/docs/qinterra_wireline_tractor_catalouge.

*Primary Examiner* — Robert E Fuller
*Assistant Examiner* — Neel Girish Patel
(74) *Attorney, Agent, or Firm* — GableGotwals

(57) ABSTRACT

This invention relates to a tractor for use in a wellbore, an apparatus for use in the tractor and related methods. In one embodiment the apparatus has a body, a drive wheel and a movable arm for supporting drive wheel. The arm may be rotatably movable using an actuator such that the drive wheel can be extracted from the body and brought into engagement with a wall of the wellbore, and may be arranged to be offset from a central region of the apparatus for providing accommodation space for the actuator in the body.

29 Claims, 7 Drawing Sheets

(56) References Cited

U.S. PATENT DOCUMENTS

| | | | | |
|---|---|---|---|---|
| 2014/0013731 | A1* | 1/2014 | Hallundbåk | E21B 23/14 60/325 |
| 2014/0014323 | A1* | 1/2014 | Hallundbåk | E21B 23/04 166/243 |
| 2014/0014367 | A1* | 1/2014 | Hallundbåk | B60K 7/0015 166/381 |
| 2014/0014369 | A1* | 1/2014 | Hallundbåk | E21B 23/14 166/381 |
| 2014/0116729 | A1* | 5/2014 | Al-Mulhem | E21B 23/14 166/381 |
| 2014/0174760 | A1* | 6/2014 | Slocum | E21B 4/18 166/381 |
| 2015/0167416 | A1* | 6/2015 | Ludwig | E21B 23/14 166/385 |
| 2015/0218900 | A1* | 8/2015 | Hallundbåk | E21B 43/25 166/66.4 |
| 2015/0300113 | A1* | 10/2015 | Guttormsen | E21B 4/18 166/65.1 |
| 2016/0333653 | A1* | 11/2016 | Bonderover | E21B 23/14 |

FOREIGN PATENT DOCUMENTS

| | | | |
|---|---|---|---|
| WO | 2008091157 | A1 | 7/2008 |
| WO | 2008111844 | A1 | 9/2008 |
| WO | 2010123375 | A1 | 10/2010 |
| WO | 2014081305 | A1 | 5/2014 |
| WO | 2015036574 | A2 | 9/2014 |
| WO | 2015112022 | A1 | 7/2015 |

* cited by examiner

APPARATUS FOR USE IN A TRACTOR IN A WELLBORE AND METHODS

CROSS-REFERENCE TO RELATED APPLICATIONS

This United States application is the National Phase of PCT Application No. PCT/NO2016/050059 filed 31 Mar. 2016, which claims priority to Norwegian Patent Application No. 20150395 filed 1 Apr. 2015, each of which is incorporated herein by reference.

BACKGROUND OF THE INVENTION

Technical Field

The present invention relates to apparatus for use in a tractor in a wellbore, a tractor including the apparatus, and related methods.

Background

In the oil and gas exploration and production industry, wells in the subsurface of the Earth are commonly provided for extracting hydrocarbon fluids such as oil and gas. In providing such a well, a wellbore is provided which extends through the geological rock formations in the subsurface of the Earth in order to access the natural resource. In the extraction of hydrocarbon fluids, the wellbore can provide a path for the fluids to flow upwards from the subsurface and out of the well. The wellbore is normally constructed by drilling into the Earth's surface.

It has been increasingly of interest to extract hydrocarbon fluids from remote locations. To this end, long-reaching wells may be employed where the far reaches of the wellbore have a horizontal or near horizontal trajectory. Such wellbores may be several kilometers in length.

Various operations may be required to be performed during the drilling, construction, operation or abandonment phases of the well. During the lifetime of the well, it may in particular be important to perform well intervention operations in the wellbore in order to allow the hydrocarbon fluids to be recovered, or to improve recovery from the well.

In order to perform such operations, a suitable tool or string of tools is typically deployed in the wellbore on a wireline from the surface. The tool or tools may be connected to the wireline at a leading end of the wireline, and the wireline may then be spooled out from a wireline winch unit so that the wireline with the tool(s) attached enters and moves through the wellbore to the required location. When the operation is finished, the wireline winch unit pulls the tool(s) out of the well.

In a vertical section of the wellbore, the tool(s) can typically progress relatively freely through the wellbore, but as the wellbore deviates from the vertical section to sections of the well where the trajectory is horizontal or near horizontal, the wireline and tool(s) will tend to lie against the lower side of the wellbore due to gravity, and frictional forces or obstructions between the wireline or tool(s) and the wall may hinder further progress of the tool(s) along the wellbore. To deal with this, the wireline may be provided with a wireline tractor which may be activated when required to provide traction against the wall to help pull the wireline and tool(s) along the wellbore.

In FIGS. 1 and 2, there is shown a prior art drive section 1 for a wireline tractor of the kind described above. The drive section 1 has a drive wheel 5 mounted on a movable arm 6. The arm 6 is rotatably connected to a body 2 of the drive section 1 at a first end. The arm 6 is operable to rotate so that the drive wheel 4 is extracted from a slot 7 in the body 2, and is moved radially in an arc out from the body 2 to bring the wheel 5 into engagement with the wall of the wellbore. The drive wheel 5 is urged against the wall by operation of the arm 6. The drive wheel 5 is operated to rotate with respect to the arm 6, whereby traction is generated for moving the tractor along the wellbore.

The drive section 1 is designed with the arm 6 and drive wheel 5 arranged centrally within the body 2. Providing a central arm 6 has been a natural approach for supporting a central drive wheel 5, where the central position of the wheel 5 can help to align the tractor and avoid possible rotation of the tractor or equipment when being driven along the wellbore.

SUMMARY OF THE INVENTION

The inventors have identified a number of limitations associated with prior art drive sections. In particular, it is realized that the space constraints imposed by the central configuration of the arm can be significant and can be a severe hindrance in both the size and flexibility of configuration of components, in particular arm actuators, in the body of the drive section adjacent to the arm. Actuators for operating the arm can suffer particularly, where the actuator may need to be above a certain size in order to generate a significant force for engaging the wall of the wellbore. In a hydraulic actuator using a piston for instance, the power generated can be dependent upon the fluid contact area of the piston, scaling by a square law. Such difficulties may be exacerbated in narrow borehole designs.

According to a first aspect of the invention, there is provided apparatus for use in a tractor in a wellbore, the apparatus comprising:

- a body;
- tractor propulsion means; and
- a movable support for supporting the tractor propulsion means, the support being movable using an actuator such that the tractor propulsion means can be extracted from the body and brought into engagement with a wall of the wellbore;
- at least one portion of the support being offset from a central region of the apparatus for providing accommodation space in the body.

In particular, the at least one portion of the support may be offset from the central region of the apparatus for providing accommodation space for the actuator in the body.

In this way, the support can be offset from the central region for example by an offset distance separating or spacing the support away from the central region, e.g. radially. It can typically be preferable for the support to be substantially entirely offset from the central region. The support can be offset from the central region in one or more selected regions or locations along the length of the apparatus, body and/or the support. In particular, the portion of the support adjacent to the actuator in the body may be offset from the central region. The apparatus and/or the body may have a central longitudinal axis and the portion of the support may be offset from the central axis, e.g. spaced radially away from the central region and/or the central axis. The tractor propulsion means may preferably be extracted from a slot in the body. In a first region, e.g. a first end, the slot may be adapted to accommodate a first portion of the support, and in a second region, e.g. a second end, the slot may be adapted to accommodate the tractor propulsion means and a second portion of the support. The slot, e.g. a side wall thereof, may typically have a step between the first and second region. This may facilitate adaption of the slot for accommodating the support. The first region of the slot may typically be offset from the central region, e.g. the central longitudinal axis, of the apparatus. The slot may preferably penetrate completely through the body.

The movable support may preferably be rotatably movable. The support may be coupled to the body via a rotational joint for allowing rotational movement of the support relative to the body for extracting the tractor propulsion means.

The tractor propulsion means may typically be movable relative to the support. The tractor propulsion means may preferably be powered by fluid. The tractor propulsion means may be operable to move using a motor housed in the support. The motor typically comprises a hydraulic wheel motor, but could for example comprise an electric motor. The support may typically therefore have one or more fluid channels for supplying fluid for operating the motor.

The tractor propulsion means may comprise at least one drive wheel, for driving the tractor along the wellbore. The drive wheel may typically have a contact surface such as a gripping surface for contacting the wall of the wellbore, but in other embodiments the tractor propulsion means may comprise a drive member such as a belt or chain or the like. The drive member may be driven by the drive wheel, and may be fitted with a contact or gripping surface for contacting the wall of the wellbore. The drive wheel may take the form of for example a toothed or grooved wheel for driving such a contact member.

The tractor propulsion means may preferably be arranged centrally with respect to the body. When housed, for example, the tractor propulsion means may be arranged on the central longitudinal axis. The tractor propulsion means may preferably be configured so as to track along the body, e.g. with a component of movement parallel with the central axis, for propulsion of the tractor axially along the wellbore.

The apparatus may further comprise a mount for connecting the tractor propulsion means to the support, e.g. to a side of the support. The mount may typically extend from a side of the support. The tractor propulsion means may typically be configured to rotate about the mount.

The actuator may be fluid driven. Accordingly, the actuator may be a hydraulic actuator. The actuator may thus comprise an actuating piston for actuating the support. Where the support comprises an arm, the actuator may be an arm actuating piston. The actuator may typically occupy at least part of the central region of the apparatus.

The body may typically be elongate axially along the wellbore. Typically, the body is cylindrical. The body may have a central longitudinal axis extending therethrough. The body may typically be in the form of a cylindrical housing. The housing may comprise first and second parts arranged to be fastened together, using screws, bolts, clamps or the like, or any other suitable fixing means. The slot may be defined between the first and second parts. The slot may be arranged along the housing, and may be offset from the central region, e.g. spaced radially away from the central axis.

The apparatus may further comprise a first flow circuit used for supplying fluid for moving the support relative to the body, and a second flow circuit used for supplying fluid for moving the tractor propulsion means relative to the support.

The support may preferably be an arm. The tractor propulsion means may preferably be mounted at a far portion of the support, e.g. at a far end, to be moved out of the body, e.g. rotatably, for extracting the tractor propulsion means.

The support may preferably be coupled to the body at a near portion, e.g. a near end, of the support. The support may thus be coupled at the near portion, while allowing the far portion to be moved out of the body, e.g. rotatably, for extracting the tractor propulsion means. The support may preferably be coupled to the body at a rotational joint. The support may be connected to a connector or engaging member for coupling the support to the body. The support may engage with an engaging member, e.g. with an engager or part thereof, in the slot, for coupling the support to the body. The engaging member may comprise a pin. The engaging member may be configured to be rotatable by use of the actuator. Typically, the support may interlock with the engaging member. In this way, rotation of engaging member may produce rotation of the arm. The engaging member may have a formation for interlocking with corresponding formation on the support. The support may preferably be rotatably movable, e.g. via a rotational joint for coupling the support to the body. The support may be rotatable relative to the body about a first axis. The tractor propulsion means may be rotatable relative to the support about a second axis, wherein the first and second axes may typically be parallel.

The apparatus may have a first configuration in which the tractor propulsion means is retracted in the housing, and a second configuration in which the tractor propulsion means may be extracted from the housing. The first and second axes may advantageously be parallel with one another in both of the first and second configurations. The plane of rotation of the tractor propulsion means may remain unchanged in the first and second configurations, and/or during the movement therebetween.

The apparatus may further comprise at least one service line for supplying a service for operating a well intervention tool, e.g. from a first end to a second end of the body.

The tractor may preferably be a wireline tractor.

The movable support may be activated to move when required, e.g. upon receipt of a signal. Upon movement of the support, the tractor propulsion means may be operated to engage with the wall of the wellbore. The support may be operated such that the tractor propulsion means is urged and pressed against the wall of the wellbore. This may push the body away from the wall. The activation of movement of the support (relative to the body), and/or the tractor propulsion means (relative to the support) may be performed once the apparatus is deployed in the wellbore.

The body may be arranged to be provided longitudinally along the wellbore when in use. The body may comprise first and second ends. The first end may be configured to be coupled to a wireline. The tractor may be used to move the wireline along the wellbore into or out of the wellbore. The first end may be configured for connecting the body to an adjacent section in the tractor. The adjacent section may comprise a motor section or a pump section. The first and/or second end may include at least one hydraulic fluid connector or electrical connector for fluid or electrical supply. The body may have a first end coupled to a fluid supply and a second end coupled to a downhole device. The downhole device may comprise at least one downhole tool, such as a well intervention tool. The downhole device may comprise measurement sensors and/other instruments. The housing may include electrical connections or fluid connections, e.g. connecting lines or fluid conduits, etc, extending through the housing between the first and second ends. The body may be adapted to convey electrical energy and/or fluid between the first end and the second end of the housing, for example to carry services such as electrical energy and/or hydraulic fluid between the first and second ends.

According to a second aspect of the invention, there is provided apparatus for use in a tractor in a wellbore, the apparatus comprising:

a body; and at least one engaging structure which comprises:

tractor propulsion means; and movable support means for supporting the tractor propulsion means, the support means being movable using an actuator such that the tractor propulsion means can be extracted from the body and brought into engagement with a wall of the wellbore;

at least one portion of the support means being offset from a central region of the apparatus for providing accommodation space in the body.

In particular, the at least one portion of the support means may be offset from the central region of the apparatus for providing accommodation space for the actuator in the body.

According to a third aspect of the invention, there is provided apparatus for use in a tractor in a wellbore, the apparatus comprising:

a body;

tractor propulsion means;

at least one movable support for supporting the tractor propulsion means; and at least one actuator;

the support being movable using the actuator such that the tractor propulsion means can be extracted from the body and brought into engagement with a wall of the wellbore;

at least one portion of the support adjacent to the actuator being offset from a central region of the apparatus.

According to a fourth aspect of the invention, there is provided apparatus for use in a tractor in a wellbore, the apparatus comprising:

a body;

tractor propulsion means; and a movable support for supporting the tractor propulsion means, the support being movable using an actuator such that the tractor propulsion means can be extracted from a slot in the body and brought into engagement with a wall of the wellbore;

at least one portion of the slot being offset from a central region of the apparatus.

In particular, the at least one portion of the slot may be offset from the central region of the apparatus for providing accommodation space, in particular for the actuator, in the body. The portion of the slot may be adapted to house a corresponding portion of the support.

According to a fifth aspect of the invention, there is provided apparatus for use in a tractor in a wellbore, the apparatus comprising:

a body having a central longitudinal axis;

tractor propulsion means; and a movable support for supporting the tractor propulsion means, the support being movable using an actuator such that the tractor propulsion means can be extracted from the body and brought into engagement with a wall of the wellbore;

at least one portion of the support being positioned for allowing the actuator, or a part associated therewith, to be accommodated within the body with at least part of the actuator or the associated part being disposed either on the central longitudinal axis or in a region between the arm and the central longitudinal axis, or both.

The part associated with the actuator may comprise a connecting part between the support and the actuator for connection therebetween. The connecting part may facilitate communicating power for use in actuating the support.

The portion of the support may be offset from the central region or central longitudinal axis.

According to a sixth aspect of the invention, there is provided a method of using the apparatus of any of the above aspects.

According to a seventh aspect of the invention, there is provided a method of moving equipment along a wellbore using the apparatus of any of the above aspects.

According to an eighth aspect of the invention, there is provided a tractor for use in a wellbore including the apparatus of any of the above aspects.

Any of the above aspects of the invention may include further features as described in relation to any other aspect, wherever described herein. In any of the above aspects, or any further features defined in relation to such aspects, the term "offset from a (or "the) central region of the apparatus" may be replaced by the term "offset from a (or "the") central longitudinal axis of the apparatus and/or the body". Features described in one embodiment may be combined in other embodiments. For example, a selected feature from a first embodiment that is compatible with the arrangement in a second embodiment may be employed, e.g. as an additional, alternative or optional feature, e.g. inserted or exchanged for a similar or like feature, in the second embodiment to perform (in the second embodiment) in the same or corresponding manner as it does in the first embodiment.

Embodiments of the invention are advantageous in various ways as will be apparent from the specification throughout. In particular, embodiments of the invention can provide advantages in the arrangement of components and usage of space within the apparatus that go against conventional design approaches. For example, increased power may be generated via the actuator for moving the support. Advantages in the improved availability and/or usage of space can also improve the flexibility and available options in the type and number of service lines extending through the drive section from one end to the other, and consequently may help to improve the flexibility and available options in the number and type of downhole devices or tools that can be supported by such service lines.

Whilst it is can be noted that a single hydraulic supply circuit might be used in certain embodiments for moving the arm and for driving wheel rotation for reducing the space occupied, embodiments where the arm and the drive wheel are operated and controllable independently, e.g. operated via separate supply circuits, can be advantageous. This may be favourable when the apparatus may be used in open hole in a soft formation in which it may be useful to reduce the force imparted by the arm against the formation and/or to increase propulsion power to the wheel.

DESCRIPTION AND DRAWINGS

There will now be described, by way of example only, embodiments of the invention with reference to the accompanying drawings, in which.

Figure 1:
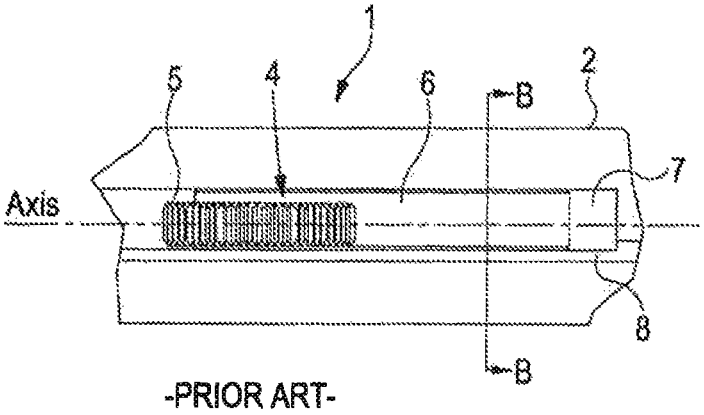
FIG. 1 is a side-view representation of a prior art drive section for use in a wireline tractor.
Figure 2:
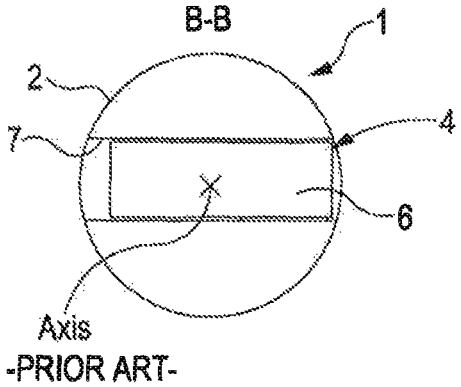
FIG. 2 is a cross-sectional representation the drive section of FIG. 1 along the line AA.
Figure 3:
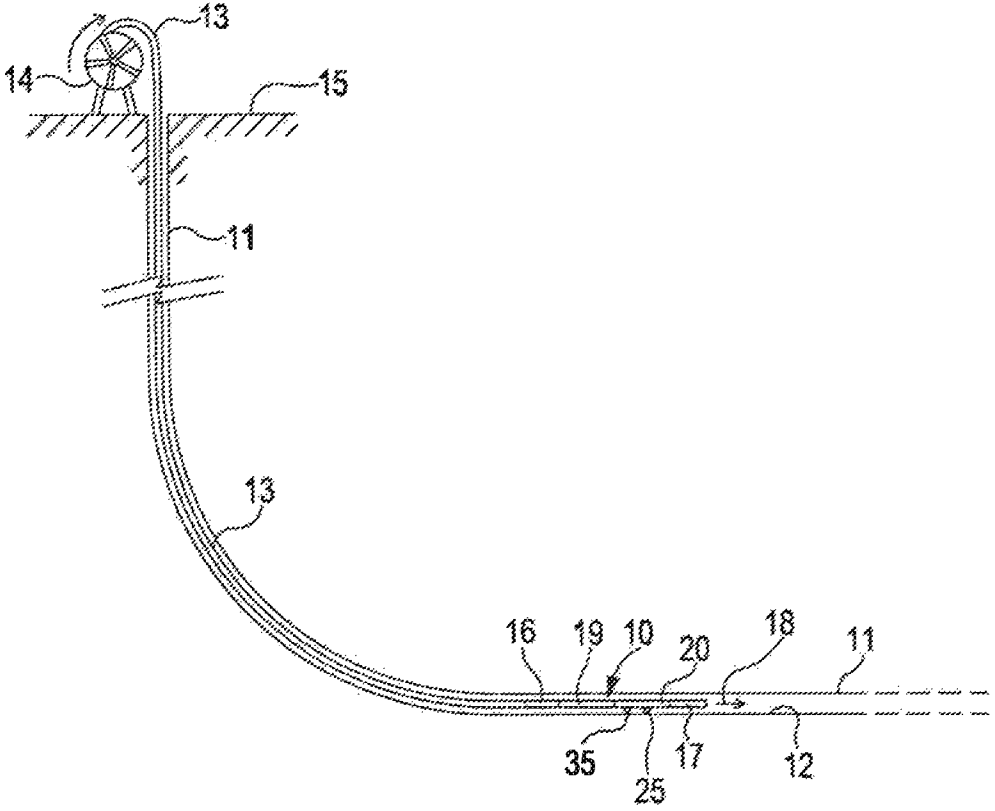
FIG. 3 is a schematic representation of a wireline tractor including a drive section for use in the wireline tractor during use in a wellbore, according to an embodiment of the invention.

Turning firstly to FIG. 3, there is shown a wireline tractor 10 in use in a wellbore 11. The wireline tractor 10 includes apparatus in the form of a drive section 20 for engaging a wall 12 of the wellbore 11. The drive section 20 has tractor propulsion means in the form of drive wheels 25, 35 which are arranged to be brought into contact against the wall 12 for providing traction for driving the wireline along the wellbore 11.

The wireline tractor 10 is coupled to a wireline 13 which is spooled out from a winch drum 14 at the surface, in this example on a platform 15 provided at the top of the wellbore 11. By engaging the drive wheels 25, 35 against the wall 12 and operating the tractor 10, the wireline 13 can be spaced off the lower side of the wellbore 11 and can be pulled along the wellbore 13 as indicated by the arrow 18 using the translational force (or traction) generated by the drive wheels 25, 35 upon the wall 12. The wireline 13 is also provided with wellbore tools in the form of well intervention tools 16, 17. The well intervention tools 16, 17 in this example are connected to the tractor 10 on either side of the tractor 10. The tractor 10 includes a motor section 19 connected to the drive section 20.

The wireline 13 includes an electrical line (not shown) for supplying the tractor 10 and tools 16, 17 with electrical energy, e.g. for providing signals or electrical power for the tools 16, 17 for operating or controlling them electrically. The electrical energy is also used to operate hydraulic components for operating the tractor 10, as will be described further below. The tractor can thus be considered an electrohydraulic tractor.

Figure 4:
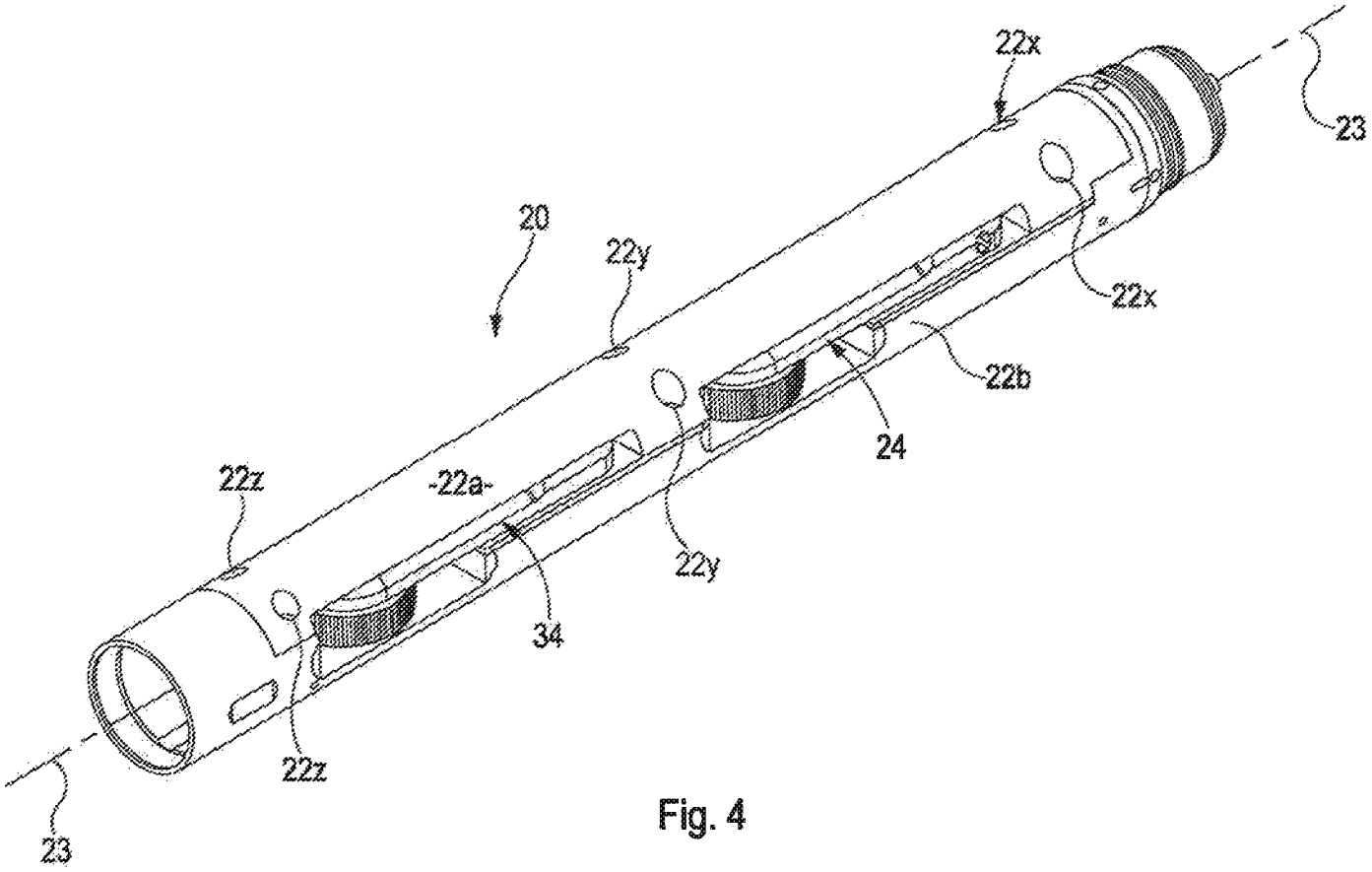
FIG. 4 is a perspective representation of the drive section of FIG. 3.
Figure 6:
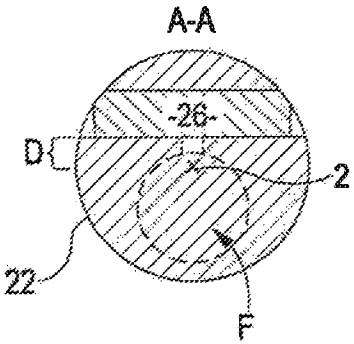
FIG. 6 is a cross-sectional representation of the engaging structure of the drive section of FIG. 5 along the line AA.
Figure 5:
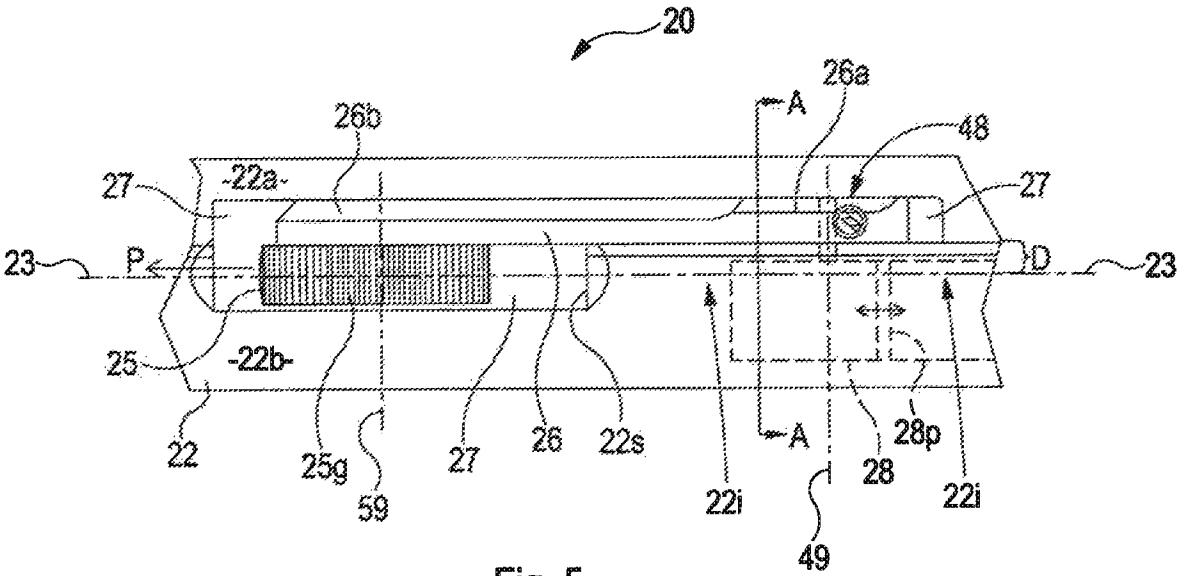
FIG. 5 is a side-view representation of an engaging structure for the drive section of FIGS. 3 and 4.

With reference to FIGS. 4 to 6, the drive section 20 of the wireline tractor 10 is described in further detail. The drive section 20 has an elongate cylindrical body 22 having a central longitudinal axis 23 extending therethrough, between ends. The body 22 extends between a first, pin end to a second, box end for enabling connection with adjacent sections of the tractor or other equipment to the respective ends. The body 22 has first and second parts 22*a*, 22*b* which are fastened together with suitable fasteners 22*x*, 22*y*, 22*z* [such as screws, bolts, rivets, press studs or the like] to form a cylindrical structure. The drive section 20 has first and second engaging structures 24, 34 spaced apart from one another along the body 22. Only the first engaging structure 24 is described specifically in the following, for purposes of clarity. The second engaging structure 34 is configured in the same way as the first engaging structure 24.

The drive section 20 has a movable arm 26 provided with a drive wheel 25. The arm 26 is arranged to be rotated to extract the wheel 25 from the body 22 and bring the wheel 25 into engagement with the wall of the wellbore. The arm 26 acts to urge and press the drive wheel 25 against the wall 12. Rotation of the arm 26 is driven using an actuator 28, which is housed within the body 22 and which in this case comprises an arm actuating piston 28 operating by hydraulic fluid, shown schematically in FIGS. 5 and 6. The arm 26 is offset from a central region 22*i* of the drive section 20 by a distance D, in order to provide accommodation space for the actuator within the body. This allows for the provision of the piston 28*p* radially adjacent to the arm 26 with a large-cross sectional fluid contact area F for improved power generating capacity. Accordingly, it may be possible to impart an increased rotational force through the arm 26 for urging the drive wheel 25 against the wall of the wellbore. The piston 28*p* is arranged to be displaced along the body 22 by fluid pressure exerted against the piston contact area F. The piston 28*p* may be mechanically connected to the arm, as described further below, for driving the movement of the arm 26.

FIGS. 5 and 6 show a passive mode in which the wheel 25 is retracted within the body 22 and is stored for example until activation of the tractor 10 is required and the arm 26 is operated to extract the wheel 25 using the actuator 28. As can be seen, the arm 26 and the wheel 25 are housed in a slot 27 formed in the body 22. The slot 27 is narrower in a first part of the length than in a second part in which the slot width is adapted to allow the wheel 25 to be housed together with the arm 26, side-by-side.

Figure 8:
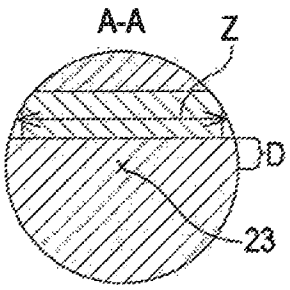
FIG. 8 is a cross-sectional representation the same as FIG. 6 but providing dimensional information.
Figure 7:
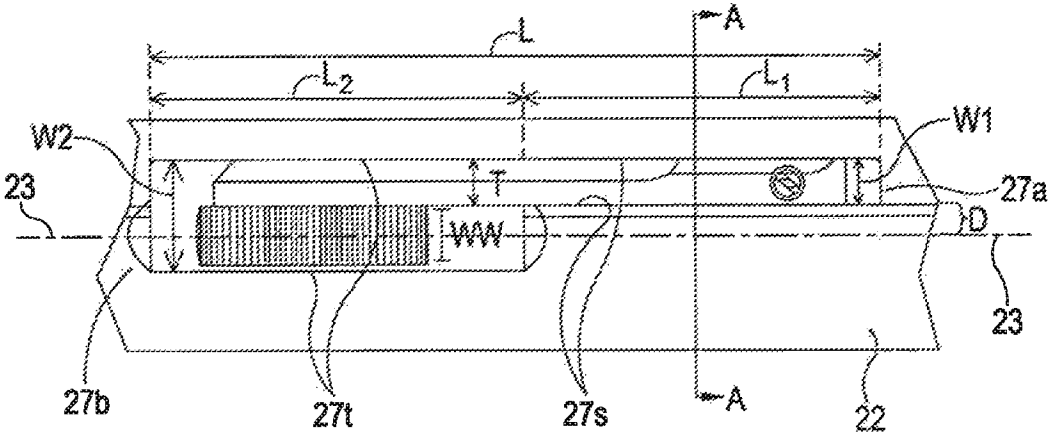
FIG. 7 is a side-view representation the same as FIG. 5 but providing dimensional information.

Dimensional parameters are illustrated in FIGS. 7 and 8 showing that the slot 27 has a length L extending along the body 22, a first width W1 at one end 27*a* where the slot 27 is offset from the central region 22*i*, and a second width W2 at the other end 27*b*, greater than the width W1, in order to store the wheel and arm in side-by-side relationship. As can be seen, a step 22*s* is formed along a side wall of the slot 27 such that the slot 27 is offset from the central region 22*i*, for facilitating the accommodation of the actuator 28 within the body 22. The step 22*s* is arranged between the first and second ends 27*a*, 27*b*, whereby the slot 27 is adapted to the structure of the arm 26 and the drive wheel 25. The portion of the slot 27 in the first part of the length L1 has a width matching the arm thickness T in a snug fit, with no substantial gap between the sides of the slot 27*s* and the arm 26, and is offset from the central region 22*i*, in the same way as the arm 26 is offset from the central region 22*i* by a distance D. The distance D separates the arm 26 and slot 27 from the central axis. The portion of the slot 27 in the second part of the length L2 has a width matching the arm thickness T and wheel width WW in a snug fit, without substantial gaps to the sides of the slot 27*t*.

The slot 27 is open to both sides of the body 22, and extends completely through the body 22. The slot 27 has openings to the slot on either side of the body 22 providing a slot space through the body from one side to the other. The reference letter Z indicates the slot depth dimension. This "open slot" configuration can help to prevent debris or particles from getting stuck inside the slot and interfering with the operation of the arm.

The wheel 25 is aligned centrally with respect to the housing 22, on the axis 23, and rotates to generate propulsion of the tractor and connected equipment in the direction indicated by arrow P is along the axis 23. Central orientation of the wheel 25 can help to keep the tractor 10 aligned and the drive wheel 25 engaged against the wellbore as the tractor 10 travels along the wellbore.

By way of the offset configuration of the arm 26, space is freed up in the central region 22*i* of the body 22 for the provision of other components. In particular, it allows a substantially-sized arm actuating piston 28 to be installed making use of the central region 22*i*, adjacent to the arm. A significant uninterrupted region of space suitable for accommodating large-cross section fluid channels is made available in the body 22 to one side of the arm 26. It may also facilitate the arrangement of service lines in the body 22.

The support arm 26 has length extending between first and second ends 26*a*, 26*b*. The arm 26 is coupled to the body 22 in the slot 27 via the rotational joint 48 at the first end 26*a*. The drive wheel is mounted on the arm at the second, far end 26*b*. The rotational joint 48 allows the arm to be rotated to extract the drive wheel 25. Upon rotation, the far end of the arm 26*b* is rotated out in an arc and is extracted from the body 22, so that the wheel 25 is correspondingly extracted and brought to an active position in which the wheel 25 engages with the wall of the wellbore for generating movement, and hence propulsion of the tractor, along the wellbore.

Figure 9:
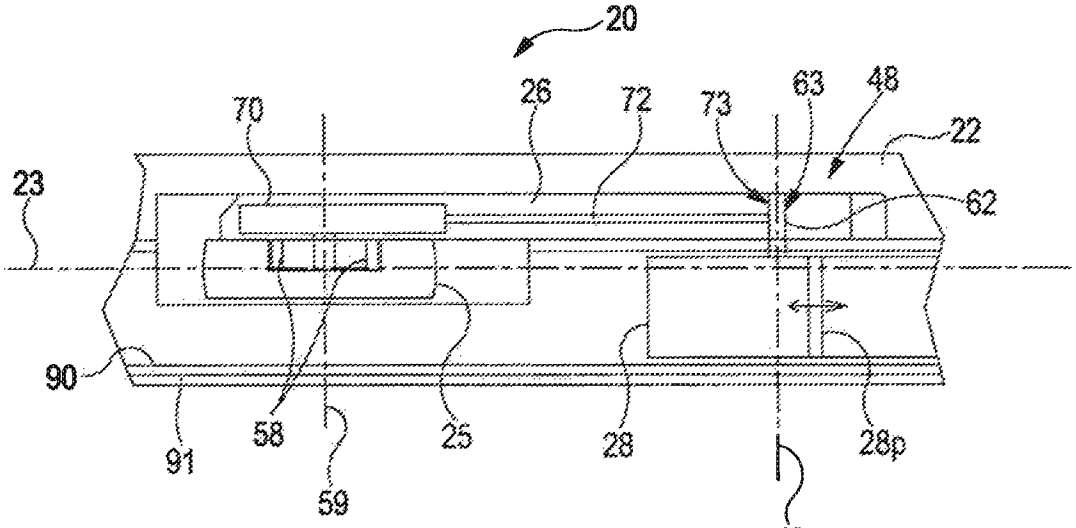
FIG. 9 is a side schematic side representation showing, in schematic layout, particular internal features of the drive section of FIGS. 4 to 8.

The arrangement of the arm 26 can be seen in further detail in FIG. 9. As can be seen in FIG. 9, the drive wheel 25 is connected to the arm 26 by a mounting pin 58 (a "mount"). The mounting pin 58 projects from a side of the support arm 26 at the second end into the wheel centre. The wheel 25 is supported on the mounting pin 58 such that it can turn about the mounting pin 58, about an axis 59. The wheel 25 is turned by operation of a drive motor in the form of a hydraulic wheel motor 70. The hydraulic wheel motor 70 is arranged within the arm 26, adjacent to the wheel 25, and typically includes multiple pistons which cooperate to rotate the wheel 25. The mounting pin 58 is fixed with respect to the arm 26, such that the movement of the wheel 25 takes place relative to the arm 26.

The rotational joint 48 has a connector member in the form of a pin 62 in the slot 27 for connecting the arm to the body 22. The arm actuator 28 is arranged in the body 22 adjacent to the first end of the arm 26, and is coupled to the pin 62 in the slot 27 such that the pin can be rotated. The pin 62 is configured to be turned about the axis 49 by operation of the actuator 28 (e.g. by coupling to the piston). The arm 26 is mounted on the pin 62 and interlocks with the pin 62. By moving the piston 28*p* using hydraulic fluid, the arm actuating piston 28*p* can act to rotate the pin 26, which in turn, by way of the interlocking arrangement with the arm, causes the arm to rotate about the axis 49. The arm 26 is typically provided with a first engaging portion 73 to engage with an engaging portion 63 of the pin 62 in the slot 27, such that the arm 26 and pin 62 are interlocked with each other. Rotation of the arm 26 in this way moves the far end of the arm 26*b* out of the body 22 toward the wall 12 of the wellbore 11.

The arm 26 in this example is in the form of a plate, and has a constant thickness T along the length of the arm 26. As can be seen, the arm 26 is arranged to the side of the wheel 25, and as such does not form any wheel arch overlapping the grip surface of the wheel 25. This can help to reduce trapping of particles and debris and reduce the risk of the wheel jamming during operation. The step 22*s* of the faces the grip surface 25*g* of the drive wheel 25 when retracted in the position of FIG. 4.

Figure 10:
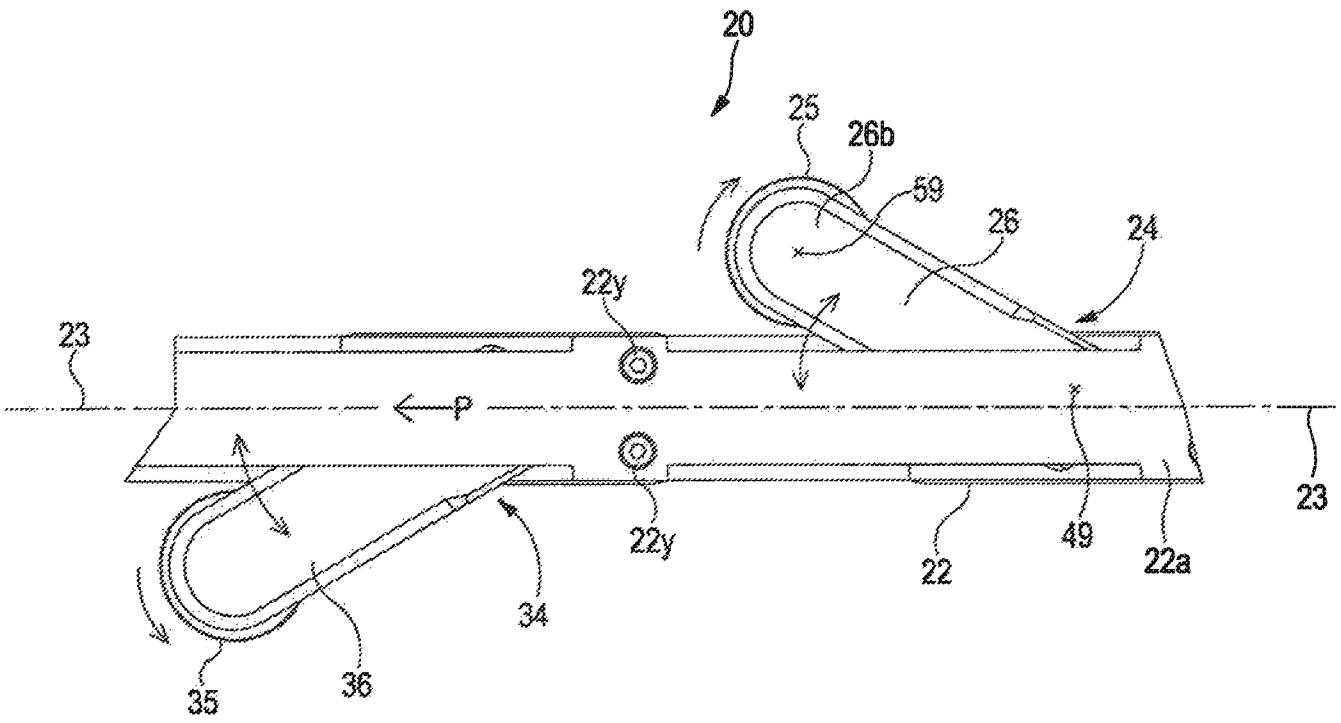
FIG. 10 is a side representation of the drive section of FIG. 3 with ends of the arms rotated out, in an engaging position.

In use, the tractor is deployed in the wellbore and activated when required. In order pull the wireline through the wellbore, the drive wheels 25, 35 are moved from the passive, housed position illustrated in FIGS. 4 to 9 into an active, engaging position as seen in FIG. 10, wherein the drive wheels 25, 35 are biased outward and are pressed against the wall 12 of the wellbore 11 by operation of the arm.

Referring again to the first engaging section 24, the actuator 28 is operated, such that the arm 26 is rotated out and the wheel 25 presses against the wall 12 of the wellbore 11, with the grip surface 25*g* in contact with the wall 12. The force by which the drive wheel 25 is pressed against the wall 12 can be significant due to the operation of a substantial sized arm actuating piston 28*p*, and by way of the force, a strong frictional contact between the wall 12 is achieved allowing the wheel 25 to grip the wall 12 and gain traction. During the rotation outward of the arm 26, the wheel 25 remains aligned centrally in the same orientation with respect to the body 22 as in the position of FIGS. 5 and 6 (except being rotated about the axis 49). The wheel motor 70 is then operated, such that the wheel 25 is rotated with respect to the arm 26, for driving the tractor 10 forward along the wall in the direction P. The arm actuating piston 28*p* is provided in actuator housing within a sealed compartment within the body 22.

The wheel 25 is rotated with respect to the arm 26 about the axis 59. The axis 59 is parallel with the axis 49 and is substantially perpendicular to the central axis 23.

The arm actuating piston 28*p* and the hydraulic wheel motor 70 are supplied with fluid from hydraulic pumps (not shown) which are driven by an electric motor (not shown) in the motor section of the tractor 10. The arm 26 has an "In" flow conduit 72 for the flow of hydraulic fluid along the arm 26 to the hydraulic wheel motor 70. The arm 26 also has an "Out" conduit for actuating fluid returning from the wheel 25 (not shown, for clarity purposes). The rotational joint 48 is adapted to allow flow into the "In" conduit 72 and out of the "Out" conduit. For example, an opening in the pin 62 may be aligned with an end of the conduit 72 in the arm so that, when the arm 26 is interconnected with the pin, fluid is allowed to flow from the body 22 through the pin 62 and into the conduit 72 in the arm 26. Suitable fluid conduits are provided for the flow of fluid to and from actuator 28, for operating the arm actuating piston 28*p*.

The arm actuating piston 28*p* and the hydraulic wheel motor 70 are operable independently of one another. Typically, different pumps are used for the arm actuating piston 28*p* and the hydraulic wheel motor 70. The pumps can be operated by separate electric motors. The electric motors and the pumps can be controlled and/or operated remotely, for example upon receipt of a control signal from a remote source.

Such a signal may be supplied remotely through a signal line, e.g. an electrical or optical line, and such a signal may be transmitted through the wireline 13. Thus, the tractor 10, and the operation of the arm 26 and drive wheel 25, may be activated by a remote signal transmitted through the wireline 13.

Upon receipt of an activation signal, for example transmitted optically, the tractor 13 may operate to be activated for engaging the wall 12 of the wellbore using the arm 26 and wheel 25. Conversely, when it is sought to deactivate the tractor 10 (e.g., when use of the tractor is no longer required), one or more deactivation signals may be transmitted upon receipt of which the motors controlling the respective rotations of the support arm 26 and the wheel 25 initiate rotation of the arm 26 in reverse, and to retract the wheel 25 back into the body 22 to the passive configuration of FIGS. 4 to 9.

In FIG. 9, service lines 90, 91 can be seen which extend past the engaging structure 26 along the drive section 20 from one end to the other, for conveying services to between sections of the tractor adjacent to the drive section 20, such as fluids conduits, electrical energy, signals, data, or other services. The lines may be optical, electrical, or fluid lines.

Typically, a plurality of engaging structures 24, 34 are provided to obtain sufficient traction. The engaging structure 34 is configured in the same way as that of the section 24 described above, although the arm 36 is configured to rotate in the opposite sense, as seen in FIG. 9, so that the ends of the arms are moved out on opposite sides of the body 22. The arms 33, 26 may typically be offset from the central region 22*i* to the same side of the body 22 in the adjacent engaging structures 24, 34 along the drive section 20.

Various modifications and improvements may be made without departing from the scope of the invention herein described.

Whilst in the examples described above the hydraulic wheel motor 70 is provided in the arm, in other variants the wheel motor 70 is arranged within drive wheel 25, e.g. inside the mounting pin 58, i.e. not in the arm 26.

Although the motor section 19 in the examples above uses electric motors for driving the pumps, a fluid-driven motor can be used instead, such as for example a downhole fluid turbine, or an electrohydraulic motor, for operation of the arm engaging piston 28*p* and/or the hydraulic wheel motor 70. Electrical power for the electric or electrohydraulic motor may be supplied from a battery for example provided downhole, or could be supplied from a power source at the surface (e.g. by transmitting power through the wireline 13 to which the tractor 10 is connected).

The invention provides a number of advantages by virtue of offsetting the support arm 26 from the central region 22*i*. As noted above, an arm actuating piston 28*p* can be provided that can be used to generate greater force against the wellbore wall allowing a better tractor drive performance. A smaller diameter tractor may be developed for a given power such that smaller diameters and far reaches of wells can be reached more easily. Space is freed up which may allow better accommodation of components within the housing. The arm 26 can have greater thickness dimension in order for example to accommodate a drive wheel motor 70 in the arm 26, whilst the wheel 25 does not need a motor inside and can be made smaller. The greater thickness may improve the arm strength, allowing greater forces to be transmitted through the arm 26. Thus, the tractor 10 may be made more robust.

Further advantages include greater options and flexibility for provision of other components. For example, service lines 90, 91 may have greater space in which to pass by the engaging structure 24 from one end of the housing 22 to the other. This may be useful where borehole devices or tools requiring services such as fluid, power or signals, are positioned downhole of the engaging structure 24 and/or drive section 20, and may allow a greater variety and flexibility in the types of tools that may be employed using the tractor 10. This in turn may reduce the number of trips needed into the wellbore 11, and can contribute to reduced costs and time in performing borehole operations, such as well intervention operations. Such benefits can be significant where it is sought to deploy tools to perform operations in far reaches of long wells.

The invention claimed is:

1. Apparatus (20) for use in a tractor (10) in a wellbore (11), the tractor being a wireline tractor, the apparatus (20) comprising,:

a cylindrical body (22) extending in a longitudinal direction between a first end and a second end of the body and having a central longitudinal axis (23) and a radial direction that is perpendicular to the central longitudinal axis;

drive wheel (25, 35);

a hydraulic actuator (28) accommodated in the cylindrical body;

a movable arm (26) for supporting the drive wheel (25), the movable arm (26) being rotatably movable using the hydraulic actuator (28) such that the drive wheel (25, 35) can be extracted outwardly from the cylindrical body (22) and brought into engagement with a surrounding wall (12) of the wellbore (11) wherein the movable arm (26) extends between a first end portion (26*a*) at which the movable arm (26) is rotatably connected to the cylindrical body (22), and a second end portion (26*b*) to be extracted from the cylindrical body (22) and at which the drive wheel (25, 35) is rotatably mounted;

a slot (27) in the cylindrical body extending in the longitudinal direction between a first end portion (27*a*) of the slot and a second end portion (27*b*) of the slot, the second end portion (26*b*) of the movable arm (26) being extractable from the slot (27);

the first end portion (27*a*) of the slot having first and second sidewalls and a width (W1) therebetween for housing the first end portion (26*a*) of the movable arm, the width (W1) extending transverse to the longitudinal direction of the slot and in the radial direction;

a coupling including a pin (62) that extends between the first end portion (27*a*) of the moveable arm (26) and the hydraulic actuator (28) in the radial direction through the first sidewall of the first end portion (27*a*) of the slot and arranged to couple between the first end portion (26*a*) of the movable arm and the hydraulic actuator (28);

wherein the movable arm (26) in its entire width and length is spaced apart from and does not intersect the central longitudinal axis (23) in the radial direction; and wherein the hydraulic actuator (28) is accommodated centrally in the cylindrical body (22) so that at least part of the hydraulic actuator (28) is situated radially adjacent the movable arm (26) which at least part of the hydraulic actuator and movable arm are arranged on opposite sides of the first sidewall of the first end portion (27*a*) of the slot (27); and wherein the drive wheel (25, 35) is arranged centrally with respect to the cylindrical body (22), the central longitudinal axis (23) intersecting a grip surface of the drive wheel (25,35) between sides of the drive wheel (25,35) and extending through the grip surface of the drive wheel (25, 35) when housed in the second end (27*b*) of the slot.

2. Apparatus as claimed in claim 1, wherein the second end portion (27*b*) of the slot (27) is adapted to accommodate the drive wheel (25, 35) and the second end (26*b*) of the movable arm (26).

3. Apparatus as claimed in claim 2, wherein a side wall of the slot (27) has a step (22*s*) between the first and second end portions for facilitating adaption of the slot (27) to accommodate the movable arm (26).

4. Apparatus as claimed in claim 2, wherein the first and second sidewalls of the first end portion of the slot (27) together comprise a sidewall pair which is radially offset to one side of the central longitudinal axis such that the first sidewall in addition to the second sidewall of the first end portion (27*a*) of the slot (27) is spaced radially apart from and does not intersect the central longitudinal axis (22*i*).

5. Apparatus as claimed in claim 1, wherein the movable arm (26) is coupled to the cylindrical body (22) via a rotational joint (48) at the first end of the movable arm for allowing rotational movement of the movable arm (26, 36) relative to the cylindrical body for extracting the drive wheel (25, 35).

6. Apparatus as claimed in claim 1, wherein the drive wheel (25, 35) is operable to move relative to the movable arm (26, 36) using a motor (70) housed in the movable arm (26, 36).

7. Apparatus as claimed in claim 5, wherein the motor comprises a hydraulic motor (70).

8. Apparatus as claimed in claim 1, wherein the gripping surface (25*g*) contacts the surrounding wall (12) of the wellbore (11).

9. Apparatus as claimed in claim 1, wherein the drive wheel (25, 35) is configured to rotate about a mount (58) projecting from a side of the movable arm (36).

10. Apparatus as claimed in claim 1, which further comprises a mount (58) arranged to connect a tractor propulsion means (25, 35) on one side of the support.

11. Apparatus as claimed in claim 1, wherein the hydraulic actuator (28) comprises an arm actuating piston (28*p*).

12. Apparatus as claimed in claim 1, wherein the cylindrical body comprises a cylindrical housing.

13. Apparatus as claimed in claim 1, further comprising a first flow circuit used for supplying fluid for moving the movable arm (26, 36) relative to the cylindrical body (22), and a second flow circuit used for supplying fluid for moving the drive wheel (25, 35) relative to the movable arm (26, 36).

14. Apparatus as claimed in claim 13, having a first configuration in which the drive wheel (25, 35) is retracted in the cylindrical body (22), and a second configuration in which the drive wheel (25, 35) is extracted from the cylindrical body (22), wherein the first and second axes (49, 59) are parallel with one another in both of the first and second configurations.

15. Apparatus as claimed in claim 1, wherein the movable arm (26, 36) is rotatable relative to the cylindrical body (22) about a first axis (49) and the drive wheel (25, 35) is rotatable relative to the movable arm (26, 36) about a second axis (59), wherein the first and second axes (49, 59) are parallel.

16. Apparatus as claimed in claim 15, wherein the first and second axes are perpendicular to the central longitudinal axis.

17. Apparatus as claimed in claim 1, further comprising at least one service line (90, 91) for supplying a service for operating a well intervention tool.

18. Apparatus as claimed in claim 1 wherein the tractor is a wireline tractor (10).

19. A method of using the apparatus (20) of claim 1, wherein the method comprises:

deploying the tractor (10) including the apparatus (20) in the wellbore (11); and activating the tractor (10), engaging the wall of the wellbore using the movable arm (26, 36) and the drive wheel (25, 35).

20. Apparatus as claimed in claim 1 wherein the drive wheel (25, 35) projects width ways outside of a width extent of the movable arm (26), on one side of the movable arm (26).

21. The apparatus as claimed in claim 1, wherein the hydraulic actuator (28) is located outside the slot (27).

22. The apparatus as claimed in claim 1 wherein the first end portion (27*a*) of the slot (27) is narrower in width than the second end portion (27*b*) of the slot (27), the second end portion (27*b*) having, a width (W2) adapted to store both the drive wheel (25, 35) and the second end portion (26*b*) of the movable arm (26) side-by-side.

23. The apparatus as claimed in claim 1, wherein the movable arm (26) has a first side and a second side, wherein said second side is linear from said first end portion to said second end portion;

said drive wheel (25, 35) having a first side, a second side, and a grip surface, wherein said first side of said drive wheel (25, 35) is adjacent to and does not overlap with any portion of said second side of said movable arm (26).

24. The apparatus as claimed in claim 1, wherein a piston of the hydraulic actuator (28) is accommodated centrally in the cylindrical body (22) so that the central longitudinal axis extends through a fluid contact area of the piston.

25. The apparatus as claimed in claim 1, wherein the coupling comprises the pin (62) in the first end portion (27*a*) of the slot (27) for rotating the movable arm (26), and the hydraulic actuator (28) comprises a piston arranged to rotate the pin to rotate the movable arm (26).

26. The apparatus as claimed in claim 25, wherein the pin extends through the first sidewall of the slot (27).

27. The apparatus as claimed in claim 25, wherein the movable arm (26) is provided with a first engaging portion which is arranged to engage with a second engaging portion of the pin for interlocking the movable arm (26) and the pin.

28. Apparatus (20) for use in a tractor (10) in a wellbore (11), the apparatus (20) comprising:

a cylindrical body (22) extending in a longitudinal direction between a first end and a second end of the cylindrical body having a central longitudinal axis and a radial direction that is perpendicular to the central longitudinal axis; and at least one engaging structure (24, 34) which comprises: drive wheel (25, 35);

a hydraulic actuator (28) accommodated in the cylindrical body; and a movable arm (26, 36) for supporting the drive wheel (25, 35);

at least a portion of the hydraulic actuator (28) situated radially adjacent the moveable arm (26, 36), the movable arm (26, 36) being movable using a the hydraulic actuator (28) such that the drive wheel (25, 35) can be extracted outwardly from the cylindrical body (22) and brought into engagement with a surrounding wall (12) of the wellbore (11), wherein the movable arm (26) extends between a first end at which the movable arm (26) is rotatably connected to the cylindrical body (22), and a second end at which the drive wheel (25) is rotatably mounted;

wherein the movable arm (26) at the first end is spaced apart from and does not intersect the central longitudinal axis in a radial direction;

the drive wheel (25, 35) is arranged centrally with respect to the cylindrical body (22), the central longitudinal axis intersecting and extending through a grip surface of the drive wheel when housed;

the apparatus further comprising a coupling including a pin (62) that extends between the first end portion (27*a*) of the moveable arm (26) and the hydraulic actuator (28) in the radial direction through the first sidewall of the first end portion (27*a*) of the slot and arranged to couple between the first end portion (26*a*) of the movable arm and the hydraulic actuator (28).

29. A tractor (10) for use in a wellbore (11), said tractor comprising:

a motor section;

a drive section connected to said motor section, said drive section having a cylindrical body (22) extending in a longitudinal direction between a first end and a second end of the body and having a central longitudinal axis (23) and a radial direction that is perpendicular to the central longitudinal axis;

drive wheel (25, 35);

a hydraulic actuator (28) accommodated in the cylindrical body;

a movable arm (26) for supporting the drive wheel (25), the movable arm (26) being rotatably movable using the hydraulic actuator (28) such that the drive wheel (25, 35) can be extracted outwardly from the cylindrical body (22) and brought into engagement with a surrounding wall (12) of the wellbore (11) wherein the movable arm (26) extends between a first end portion (26*a*) at which the movable arm (26) is rotatably connected to the cylindrical body (22), and a second end portion (26*b*) to be extracted from the cylindrical body (22) and at which the drive wheel (25, 35) is rotatably mounted;

a slot (27) in the cylindrical body extending in the longitudinal direction between a first end portion (27*a*) of the slot and a second end portion (27*b*) of the slot, the second end portion (26*b*) of the movable arm (26) being extractable from the slot (27);

the first end portion (27*a*) of the slot having first and second sidewalls and a width (W1) therebetween for housing the first end portion (26*a*) of the movable arm, the width (W1) extending transverse to the longitudinal direction of the slot and in the radial direction;

a coupling including a pin (62) that extends in the radial direction through the first sidewall of the first end portion (27*a*) of the slot and arranged to couple between the first end portion (26*a*) of the movable arm and the hydraulic actuator (28);

wherein the movable arm (26) in its entire width and length is spaced apart from and does not intersect the central longitudinal axis (23) in the radial direction; and wherein the hydraulic actuator (28) is accommodated centrally in the cylindrical body (22) so that at least part of the hydraulic actuator (28) is situated radially adjacent the movable arm (26) which at least part of the hydraulic actuator and movable arm are arranged on opposite sides of the first sidewall of the first end portion (27*a*) of the slot (27); and wherein the drive wheel (25, 35) is arranged centrally with respect to the cylindrical body (22), the central longitudinal axis (23) intersecting and extending through a grip surface of the drive wheel (25, 35) when housed in the second end (27*b*) of the slot.

* * * * *